United States Patent [19]

Malott

[11] 4,135,484

[45] Jan. 23, 1979

[54] COORDINATED AND INTEGRATED FUEL AND AUXILIARY-EXHAUST SYSTEM FOR INTERNAL COMBUSTION ENGINES FOR AUTOMOBILES

[76] Inventor: John O. Malott, 5565 Columbia Pike, #707, Arlington, Va. 22204

[21] Appl. No.: 800,011

[22] Filed: May 24, 1977

[51] Int. Cl.[2] ..... F02D 13/06

[52] U.S. Cl. ..... 123/198 F

[58] Field of Search ..... 123/198 F, DIG. 6, DIG. 7, 123/97 B; 261/23 A

[56] References Cited

U.S. PATENT DOCUMENTS

| | | | |
|---|---|---|---|
| 2,114,655 | 4/1938 | Leibing | 123/198 F |
| 2,186,043 | 1/1940 | Rohlin | 123/198 F |
| 2,379,288 | 6/1945 | Ericson | 123/198 F |
| 3,578,116 | 5/1971 | Nakajima | 123/198 F X |
| 3,744,934 | 7/1973 | Veno | 123/198 F X |
| 4,019,479 | 4/1977 | Garabedian | 123/198 F |

*Primary Examiner*—Ira S. Lazarus

[57] ABSTRACT

This invention of a coordinated and integrated fuel and auxiliary-exhaust system comprises, first, of two fuel-line assemblies including their respective controls, and comprises, second, of two auxiliary-exhaust assemblies including their respective controls, said assemblies for internal combustion engines for automobiles, said engines having an even number of cylinders, said cylinders being assigned numbers beginning with the assignment of number one to the cylinder at the front end of one tier of cylinders and said numbering being continued in numerical sequence throughout said tier and throughout any other tier of cylinders in said engine, and said cylinders comprising two groups of cylinders, each group having an equal quantity of cylinders, namely, Group-one cylinders comprising of those beginning with cylinder 1 in the cylinder block in which cylinder the firing-sequence number 1 occurs and comprising of those additional cylinders in which alternately every other firing-sequence occurs thereafter totaling one-half of the entire number of firing-sequences that occur in the entire firing-sequence cycle in the engine, and Group-two cylinders comprising of all other cylinders in the cylinder block.

1 Claim, 2 Drawing Figures

FIGURE I
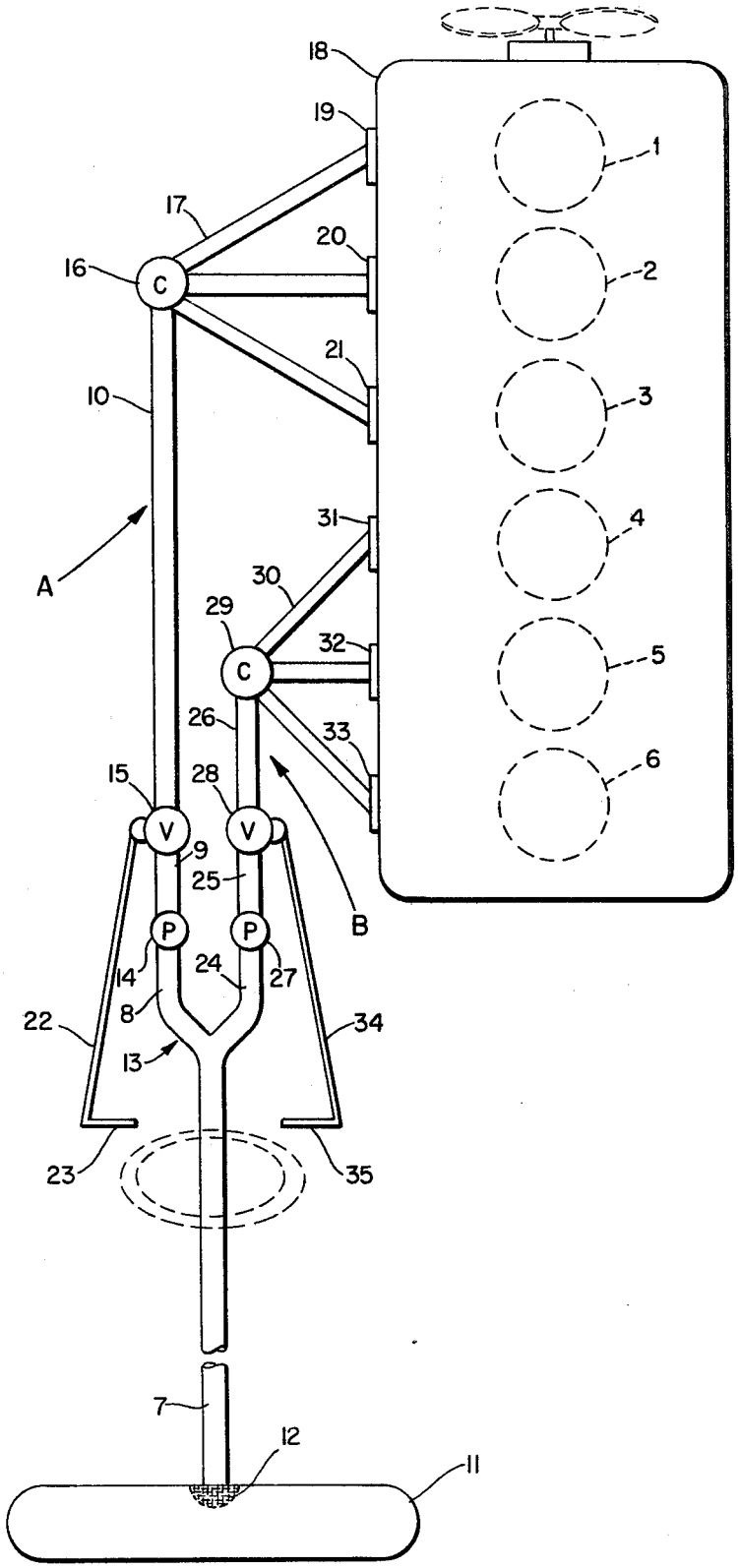

FIGURE II
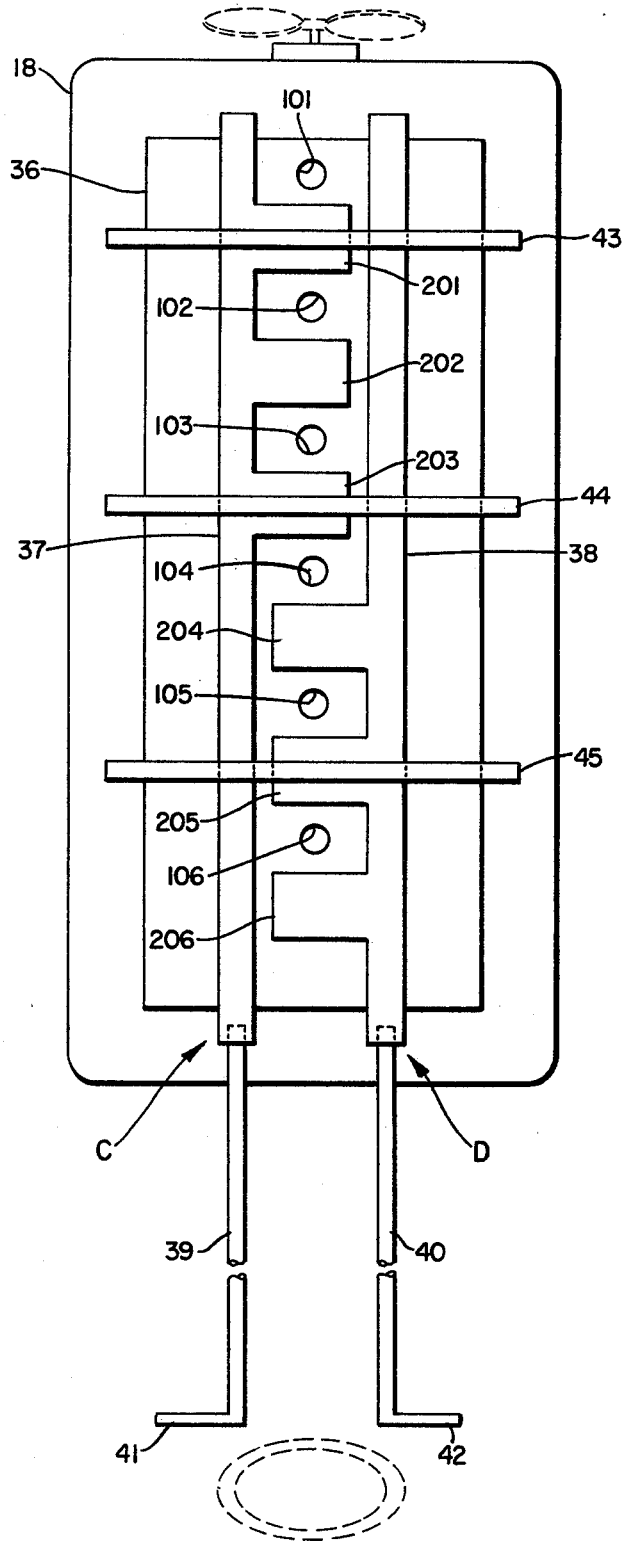

COORDINATED AND INTEGRATED FUEL AND AUXILIARY-EXHAUST SYSTEM FOR INTERNAL COMBUSTION ENGINES FOR AUTOMOBILES

SUMMARY OF THE INVENTION

One of the fuel-line assemblies herein referred to as "fuel-line assembly A" controls the feeding of fuel to Group-one cylinders and the other fuel-line assembly herein referred to as "fuel-line assembly B" controls the feeding of fuel to the Group-two cylinders.

Each fuel-line assembly comprises of the following parts connected together in the following sequence with portions of fuel-line tubing: fuel tank with fuel strainer, a Y-joint (all of which serve both fuel-line assemblies), fuel pump, fuel valve, and carburetor, and also comprises of an intake manimanifold secured at one end orifice thereof to the carburetor and at the other end orifices to the cylinder head at the intake valve chambers of the respective cylinders that are fed by the respective fuel-line assemblies A and B; and each fuel-line assembly also comprises of a valve-train leading from its fuel-valve to the control lever of said valve train in the vicinity of the steering wheel of the automobile, which control lever when actuated, opens and closes the fuel-valve to control the flow of fuel in that particular assembly from the fuel tank to the engine.

The purpose of the two fuel-line assemblies including their respective controls is to conserve fuel with a system to transport, to permit, and to control the flow of fuel only to either the Group-one or Group-two cylinders that are fed fuel by the respective fuel-line assembly A or B, at a particular time, when sufficient; second, to transport, to permit, and to control as much as a full flow of fuel only to either the cylinders fed by fuel-line assembly A or B and a restricted flow to the cylinders fed by the other assembly, when desired; and third, to transport, to permit, and to control a full flow of the fuel to all cylinders only when needed.

This invention of a coordinated and integrated fuel and auxiliary-exhaust system, also comprises, second, of two auxiliary-exhaust assemblies, including their separate controls, one assembly herein referred to as "auxiliary-exhaust assembly C" for controlling the exhaust from the Group-one cylinders, that is, those fed by fuel-line assembly A, and the other assembly herein referred to as "auxiliary-exhaust assembly D" for controlling the exhaust from the Group-two cylinders, that is, those fed by fuel-line assembly B.

Each auxiliary-exhaust assembly comprises, first, of a flat sliding-plate valve base, which serves both auxiliary-exhaust assemblies C and D and is a smooth, flat surface portion of and is on top of the engine's cylinder head and covers all of the cylinders and is as wide as the diameter of the pistons in the engine, said base being in a plane at right angles to the direction of the stroke of the engine's piston, said base having a separate orifice through same into the combustion chambers of each of the respective cylinders, the centers of said orifices being in a straight line over the centers of said respective cylinders, said orifices to serve as auxiliary-exhaust valve openings for the respective cylinders.

And each auxiliary-exhaust assembly comprises, second, of a sliding-plate piston, each of said pistons being retained in and guided by means of a frame secured to the top of the cylinder head, each of said pistons being a straight, flat strip of smooth metal as long as the flat sliding-plate valve base and uniform in the thickness and uniform in width except that one edge is indented with notches of equal length and width alternately with standing portions thereof, and which standing portions are also of equal length and width, said notches and standing portions constituting a series of auxiliary-exhaust valves on each of said flat sliding-plate pistons and each auxiliary-exhaust assembly comprises also of an auxiliary-exhaust valve-train from said piston to an auxiliary-exhaust-valve control lever in the vicinity of the steering wheel of the automobile, which levers when actuated, move the pistons with their auxiliary-exhaust valves back and forth over the orifices in said sliding-plate valve base to open and close the auxiliary-exhaust valves; and the auxiliary-exhaust assemblies thereby provide a facility to open the auxiliary-exhaust valves of either Group-one or of Group-two cylinders when fuel is being fed to and power is being produces in only the other cylinders, and to close all auxiliary-exhaust valves when fuel is being fed to and power is being produced in all cylinders. The purpose of the two auxiliary-exhaust assemblies, including their respective controls is to minimize the loss of power, which loss would otherwise occur in creating compression in the non-power-producing cylinders.

This coordinated and integrated system of fuel-line assemblies and auxiliary-exhaust assemblies together with their respective controls is for the purpose of conserving fuel in the operation of automobiles on highways and should be operated as follows:

(a) all auxiliary-exhaust valves should be closed and all fuel valves should be open to obtain maximum power, when needed;

(b) the fuel valve in one of the fuel-line assemblies should be open and the fuel valve in the other fuel-line assembly should be closed when the power derived from the cylinders that are being fed fuel is sufficient, and the auxiliary-exhaust valves for the non-power-producing cylinders should be open to minimize the loss of power, which loss would otherwise occur in creating compression in the non-power-producing cylinders; and (c) to meet intermediate power requirements, close all auxiliary-exhaust valves, provide a full flow of fuel through one fuel-line assembly and as much of a flow through the other fuel-line assembly as may be desired.

The basic factors that reveal the necessity for and the viability of this invention include the fact that fuel is the source of the power of an internal combustion engine; that the power is transmitted through the power transmission system to the driving wheels of the automobile; and that more power is required to move a given automobile having a given weight load from a stationary position and to accelerate the movement of same to a speed of forty (40) miles per hour within a distance of one hundred (100) yards on a highway than is required to maintain the speed of forty (40) miles per hour of said automobile and load for the same distance over the same highway surface. Furthermore, in each transmission speed, there is a direct ratio of the number of cycles for each piston as well as the number of revolutions of the engine to the number of miles traveled. In the traditional internal combustion engines in automobiles, fuel is fed into the cylinder during each cycle of each piston, although in much of the highway travel, fuel fed into either the Group-one or the Group-two cylinders, as described herein, would be sufficient, and much of the fuel supply would be conserved.

Some other factors in the need for this invention are: the decreases in the supply of fuel; the increases in the number of automobiles; the increases in their weight, load capacity, power, speed, luxuries, and accessories that increase the requirements for fuel; and that to achieve the purpose of this invention every effort must be made to avoid disadvantages and problems of early automobiles. High mileage per gallon, for example, was obtained from the 1899–1904 two-speed, two-cylinder high-wheel buggy-type "Beetle Flyer", weighing less than eight hundred pounds, manufactured by J. Horace Malott and Charles K. Malott at Noblesville, Indiana, but it had many deficiencies. The chief problems were noise, terrific vibrations, small pay-load capacity together with lack of safety, comfort, speed, and and power. The two-cylinder engine without a muffler was perched high on an extended buggy frame in front of the dashboard. Because of the leverage of the high perch of the engine, the high center of gravity, and the buggy-type springs, the vibrations were most unpleasant. Using this invention, an automobile engine having an even number of cylinders, for example, an eight or a four-cylinder engine, may in effect be converted for power production purposes into a four or a two-cylinder engine, respectively, at the option of the operator, under appropriate conditions without reviving vibration and other problems. This conversion may be made by merely closing the fuel valve in the fuel-line assembly for either Group-one or Group-two cylinders and by opening the auxiliary exhaust valves for the same group of cylinders. Said engine, for example, may be easily reconverted for power production purposes back to an eight or four-cylinder engine, respectively, at the option of the operator by merely opening all fuel valves and closing all auxiliary-exhaust valves. Thus, the fuel-line assemblies and the auxiliary-exhaust assemblies are coordinated and integrated into a functional system. There is a need for this facility to reduce the number of cylinders consuming fuel that is in excess of the amount of fuel required in normal highway travel.

The following is a description of the invention of a coordinated and integrated fuel and auxiliary-exhaust system that comprises, first, of two fuel-line assemblies including their respective controls and comprises, second, of two auxiliary-exhaust assemblies including their respective controls, said assemblies for internal combustion engines for automobiles and said engines having an even number of cylinders, said cylinders being assigned numbers beginning with the assignment of number one to the cylinder at the front end of one tier of cylinders and said numbering being continued in numerical sequence throughout said tier and throughout any other tier of cylinders in said engine, and said cylinders comprising two groups of cylinders, each group having an equal quantity of cylinders, namely, Group-one cylinders comprising of those beginning with cylinder 1 in the engine block in which cylinder the firing-sequence number 1 occurs, and comprising of those additional cylinders in which alternately every other firing-sequence occurs thereafter totaling one-half of the entire number of firing sequences that occur in the entire firing-sequence cycle in the engine, and Group-two cylinders comprising of all other cylinders in the engine. For example, in a six-cylinder engine having a firing sequence 1,5,3,6,2,4,, Group-one cylinders comprise cylinder 1 in the firing-sequence and alternately every other cylinder in the firing-sequence thereafter through said firing-sequence, namely, 1, 3, 2; and Group-two comprises the second cylinder in the firing sequence, namely cylinder 5 and alternately every other cylinder in the firing sequence thereafter through the firing sequence, totaling cylinders 5, 6, and 4. Likewise, in an eight-cylinder engine having a firing sequence 1, 8, 4, 3, 6, 5, 7, 2, Group-one cylinders would comprise cylinders 1, 4, 6, 7, and Group-two cylinders would comprise cylinders 8, 3, 5, 2.

One of the fuel-line assemblies herein referred to as "fuel-line assembly A" controls the feeding of fuel to Group-one cylinders and the other fuel-line assembly herein referred to as "fuel-line assembly B" controls the feeding of fuel to the Group-two cylinders.

The foregoing provisions regarding the numbering of the cylinders and regarding the firing sequences are basic to the plan to produce power only in either the Group-one or in the Group-two cylinders with a maximum of smoothness from the power thrusts of the engine. At any given number of revolutions per minute by the traditional automobile engine, the time-intervals between the firing of the cylinders is substantially equal. This invention retains the provision for equal time-intervals between the firing of the cylinders, when power is being produced by all cylinders. Likewise, at any given number of revolutions per minute of the engine, this invention retains equal time-intervals between the firing of the Group-one cylinders, when power is produced only from them, but each time interval is twice as long as it would be if all cylinders were producing power. In like manner, at the same given number of revolutions per minute of the engine, this invention retains equal time intervals between the firing of the Group-two cylinders, when power is produced only from them, but each time-interval is twice as long as it would be if all cylinders were producing power.

First, it is noted that more power and more fuel are required to move a given automobile having a given weight load from a stationary position and to accelerate the movement of same to a speed of forty miles per hour within a distance of one hundred yards on a given highway than is required to maintain the speed of forty miles per hour over the same highway surface, all other conditions remaining the same. Second, in any given transmission-gear speed, there is a direct, fixed ratio between the number of miles traveled and the number of complete firing-sequence cycles of the engine. Third, in the traditional internal combustion engines in automobiles, fuel is fed into each cylinder during each complete firing-sequence cycle of the engine, although much of it is wasted. To maintain said speed of forty miles per hour, fuel fed at a given time only into the Group-one or only into the Group-two cylinders, as described herein, has proven sufficient, thus resulting in the conservation of fuel. Furthermore, the time-intervals between the firing of the cylinders were equal and sufficiently short to avoid unpleasant vibrations.

Although the accompanying drawings illustrate the application of the mechanism and principles to an engine having six (6) cylinders, the parts, their sequence, mechanism, functions, and principles are applicable to all internal combustion engines having an even number of cylinders.

Two help clarify the following description of this invention, it is noted that the Figures are assigned Roman numerals, the fuel-line assemblies and auxiliary-exhaust assemblies are assigned capital letters, and the parts are assigned Arabic numerals.

DESCRIPTION OF THE DRAWINGS

FIG. 1 is a schematic diagram of a cylinder head for a six cylinder engine and two fuel assemblies and their respective controls.

FIG. 2 illustrates two auxiliary exhaust assemblies and their respective controls for a six cylinder engine.

DESCRIPTION OF THE PREFERRED EMBODIMENT

FIG. I is a perspective, schematic diagram showing the cylinder head for a six-cylinder engine and the two fuel-line assemblies A and B, including their respective controls. The cylinders are shown in short broken lines in cylinder head 18 and are assigned Arabic numerals 1, 2, 3, 4, 5, and 6, consecutively, beginning with the assignment of number one (1) to the cylinder at the front end of the tier of cylinders in said engine. The engine fan and the steering wheel, also shown in long broken lines, are not numbered and are not parts of this invention, but are shown for clarification purposes. One fuel-line assembly identified by capital letter "A" and referred to herein as "Fuel-line assembly A" is for transporting, permitting, and controlling the flow of the fuel to the Group-one cylinders, that is, 1, 3, and 2, and are herein referred to as "Group-one cylinders;" the other fuel-line assembly identified in FIG. I by the letter "B" and referred to herein as "Fuel-line assembly B" is for transporting, permitting, and controlling the flow of the fuel to the Group-two cylinders 5, 6, and 4 and are herein referred to as "Group-two cylinders".

Fuel-line assembly A comprises of the following parts joined together with portions of fuel-line tubing 7, 8, 9, and 10 in the following sequence, namely: fuel tank 11, fuel-tank strainer 12, Y-joint 13, (said fuel tank 11, fuel-tank strainer 12, and Y-joint 13 serving both fuel-line assemblies A and B), fuel pump 14, fuel valve 15, and carburetor 16; and comprises of an intake manifold 17 secured at one end orifice thereof to carburetor 16 and at the other end orifices to cylinder head 18 at intake valve ports 19, 20, and 21 for their respective cylinders 1, 2, and 3; and also comprises of fuel-valve train 22 secured at one end thereof to fuel valve 15 and at the other end thereof to fuel-valve control lever 23 in the vicinity of the operator of the automobile.

Fuel-line assembly B, comprises of the following parts joined together with portions of fuel-line tubing 7, 24, 25, and 26 in the following sequence namely: fuel tank 11, fuel-tank strainer 12, and Y-joint 13 (said tank 11, fuel-tank strainer 12 and Y-joint 13 serving both fuel-line assemblies A and B), fuel pump 27, fuel valve 28, and carburetor 29; and comprises of intake manifold 30 secured at one end orifice thereof to carburetor 29 and at the other end orifices to the cylinder head 18 at intake valve ports 31, 32, and 33 for their respective cylinders 4, 5 and 6; and also comprises of fuel-valve train 34 secured at one end thereof to fuel valve 28 and at the other end thereof to fuel-valve control lever 35, in the vicinity of the steering wheel of the automobile.

The following is a description of the parts and of their functions in fuel-line assemblies A and B in transporting, permitting and controlling the flow of fuel from fuel tank 11 to the Group-one and Group-two cylinders respectively. Fuel tank 11 contains the fuel which is an inflamable gas or liquid for use in internal combustion engines for conversion into power. Fuel-tank strainer 12 is a device having meshes through which the fuel passes before it is transported from the tank. Fuel-line tubing portion 7 channels the fuel from fuel tank 11 to Y-joint 13. Said Y-joint is a portion of fuel-line tubing formed into a Y-shaped joint, as in plumbing, having three orifices into one of which the fuel enters from fuel tank 11 and from the other two orifices the fuel proceeds farther through separate fuel-line assemblies A and B toward the engine. The foregoing parts serve both fuel-line assemblies A and B in the flow of the fuel from fuel tank 11 through Y-joint 13.

Immediately following, is a description of the parts for the flow of the fuel beyond Y-joint 13 in fuel-line assembly A. Beyond Y-joint 13, the fuel is channeled through fuel-line tubing portion 8 to fuel pump 14 which raises, transfers, or compresses air or fluids or attenuates gases or fluids especially by suction or pressure or both from fuel tank 11 through fuel-line tubing portion 9 to fuel valve 15. Fuel valve 15 is any of various mechanisms or structures for temporarily opening and closing a passage to control the movement of air or fluid through said mechanism or structure and through fuel-line tubing portion 10 to carburetor 16. Carburetor 16 is a device in a fuel-line assembly that mixes fuel and air and delivers the combustible mixture to the intake manifold 17. Said intake manifold is a pipe through which the air-fuel mixture passes from the carburetor 16 into the intake valve ports 19, 20, and 21 of cylinders 1, 2, and 3, respectively, and which pipe is secured at one end thereof to said carburetor 16, and which pipe having outlets at the opposite end thereof, is secured to cylinder head 18 at said intake-valve ports 19, 20, and 21. The fuel-valve train 22 is the joined-together succession of moving parts secured at one end thereof to fuel valve 15 and secured at the opposite end thereof to fuel-valve control lever 23 in the vicinity of the steering wheel of the automobile so that, when actuated, causes said valve to open and close and thereby is a facility to transport, permit and control the flow of the fuel from tank 11 to the Group-one cylinders in the engine.

In fuel-line assembly B, which transports, permits and controls the flow of the fuel to the Group-two cylinders, the flow of fuel continues from Y-joint 13 through fuel-line tubing portion 24 to fuel pump 27, to fuel-line tubing portion 25, to fuel-valve 28, to fuel-line tubing portion 26, to carburetor 29, and said carburetor delivers the combustible mixture to intake manifold 30, which mixture passes into the intake valve ports 31, 32, and 33 of cylinders 4, 5, and 6 respectively in cylinder head 18; and which fuel-line assembly has fuel-valve train 34 and fuel-valve control lever 35 which when actuated causes said fuel-valve 28 to open and to close and thereby is a facility to transport, to permit, and to control the flow of the fuel from fuel tank 11 to the Group-two cylinders in the engine. Each of the corresponding parts in fuel-line assembly A and in fuel-line assembly B have the same mechanical function.

FIG. II illustrates for a six-cylinder engine the auxiliary-exhaust system which comprises of two auxiliary-exhaust assemblies, including their separate controls, one assembly herein referred to as "auxiliary-exhaust assembly C" for controlling the exhaust from the Group-one cylinders 1, 2, and 3, that is, those fed by fuel-line assembly A, and the other auxiliary-exhaust assembly herein referred to as "auxiliary-exhaust assembly D" for controlling the exhaust from the Group-two cylinders 4, 5, and 6, that is, those fed by fuel-line assembly B.

Each auxiliary-exhaust assembly comprises, first, of a flat sliding-plate valve base 36, which serves both auxiliary-exhaust assemblies C and D, and which base is a smooth, flat surface on the top of and a part of the engine's cylinder head 18 and covering all of the cylinders 1 to 6, inclusive, and being as wide as the diameter of said pistons in the engine, and the surface of said base being in a plane at right angles to the direction of the stroke of the engine's piston, and said base having orifices 101, 102, and 103 through same into the combustion chambers of the respective Group-one cylinders 1, 2, and 3 and said base having orifices 104, 105, and 106 through same into the combustion chambers of the respective Group-two cylinders 4, 5, and 6, the centers of the said orifices being in a straight line over the centers of said respective cylinders, said orifices to serve as auxiliary-exhaust valve openings for the respective cylinders.

And second, each of the two auxiliary-exhaust assemblies, C and D, comprise respectively of a sliding-plate piston 37 and 38, said pistons being retained in and guided by means of sliding-plate piston frame portions 43, 44, and 45, secured to said cylinder head 18, each of said pistons being a straight, flat strip of smooth metal as long as the flat sliding-plate valve base 36 and said sliding-plate pistons being uniform in thickness and uniform in width except that one edge of each piston is indented with notches of equal length and width alternately with standing portions thereof, and also of equal length and width, and said standing portions constituting a series of auxiliary-exhaust valves 201, 202, and 203 on sliding-plate piston 37 and a series of auxiliary-exhaust valves 204, 205, and 206 on sliding-plate piston 38; and said assemblies C and D consisting also of auxiliary exhaust-valve trains 39 and 40, respectively from said sliding-plate pistons 37 and 38 to auxiliary exhaust-valve train control levers 41 and 42, respectively, in the vicinity of the steering wheel of the automobile which control levers 41 and 42, when actuated, move their respective sliding-plate pistons 37 and 38 so that their respective group of auxiliary-exhaust valves 201, 202, and 203 and group of auxiliary-exhaust valves 204, 205 and 206 move back and forth over the group of auxiliary-exhaust valve openings 101, 102 and 103 and group 104, 105 and 106 respectively, to open and close the auxiliary-exhaust valves for the Group-one cylinders 1, 2, and 3 and for the Group-two cylinders 4, 5, and 6, respectively; and the auxiliary-exhaust assemblies thereby provide a facility to open the auxiliary-exhaust valves of either the Group-one or Group-two cylinders when fuel is being fed to and power is being produced in only the other cylinders, and to close the auxiliary-exhaust valves of either the Group-one or Group-two cylinders when fuel is being fed to and power is being produced only in those particular cylinders, and to close all auxiliary-exhaust valves when fuel is being fed to and power is being produced in all cylinders.

A three-unit electric switch and appurtenant accessories, not shown in the Figures herein, not described herein, and not claimed herein could for the sake of ease, assurance and finesse in the operation of this coordinated and integrated fuel and auxiliary-exhaust system be substituted for control levers 23, 35, 41 and 42 as follows: one switch to be referred to as "one" switch could be activated to close the fuel valve in fuel-line assembly B and to open the auxiliary-exhaust valves in auxiliary-exhaust valve assembly D in order to produce power only from the Group-one cylinders and to avoid loss of power by eliminating compression in the Group-two cylinders and said switch could be activated to reverse this action; and one switch to be referred to as "two" switch could be activated to close the fuel valve in fuel-line assembly A and to open the auxiliary-exhaust valve in assembly C in order to produce power only from the Group-two cylinders and to avoid loss of power by eliminating compression in the Group-one cylinders and said switch could be activated to reverse this action; and one switch to be referred to as "all" could be activated to open all fuel valves and to close all auxiliary-exhaust valves in order to produce power from all cylinders.

Having described my invention, I claim:

1. In an internal combustion engine a coordinated and integrated fuel and auxiliary-exhaust system comprising; two fuel-line assemblies including their respective controls, two auxiliary-exhaust assemblies including their respective controls, said engine having an even number of cylinder, said cylinders being assigned numbers beginning with the assignment of number one to the cylinder at the front end of one tier of cylinders and said numbering being continued in numerical sequence throughout said tier and throughout any other tier of cylinders in said engine, and said cylinders comprising two groups of cylinders, each group having an equal quantity of cylinders, namely, group-one cylinders comprising those beginning with cylinder one in the cylinder block in which cylinder the firing sequence 1 occurs and group-one cylinders comprised of those additional cylinders in which alternately every other firing-sequence occurs thereafter totaling one-half of the entire number of firing-sequences that occur in the entire firing-sequence cycle in the engine, and group-two cylinders comprised of all other cylinders in the cylinder block; one of the said fuel-line assemblies herein referred to as "fuel-line assembly A" controlling the feeding of fuel to group-one cylinders and the other fuel-line assembly herein referred to as "fuel-line assembly B" controlling the feeding of fuel to the group-two cylinders; each fuel-line assembly comprised of the following parts connected together in the following sequence with portions of fuel-line tubing, namely, fuel tank with fuel strainer, and a Y-joint (all of which serve both fuel-line assemblies), fuel pump, fuel valve, and carburetor, and also comprising; an intake manifold secured at one end orifice thereof to the carburetor and at the other end orifices to the cylinders head at the intake valve chambers of the respective cylinders that are fed by the respective fuel-line assemblies A and B; and each fuel-line valve to the control lever of said valve train in the vicinity of a steering wheel of an automobile, which controls lever when actuated, opens and closes the fuel-valve to control the flow of fuel in that particular fuel-line assembly from the fuel tank to the engine; the two fuel-line assemblies including their respective controls being able to conserve fuel with a system to transport, to permit, and to control the flow of fuel only to either the group-one or group-two cylinders that are fed fuel by the respective fuel-line assembly A or B, at a particular time, when sufficient; second, to transport, to permit, and to control as much as a full flow of fuel only to either the cylinders fed by fuel-line assembly A or B and a restricted flow to the cylinders fed by the other assembly, when desired; and third, to transport, to permit, and to control a full flow of the fuel to all cylinders only when needed; and said coordinated and integrated fuel and auxiliary-exhaust system also comprising, two auxiliary-exhaust assemblies, including their separate controls, one assembly herein referred to as "auxiliary-exhaust assembly C" for controlling the exhaust from the Group-one cylinders, that is, those fed by fuel-line assembly A, and the other assembly herein referred to as "Auxiliary-exhaust assembly D" for controlling the exhaust from the Group-two cylinders, that is, those fed by fuel-line assembly B; each auxiliary-exhaust assembly comprising, a flat sliding-plate valve base (which serves both auxiliary-exhaust assemblies C and D) and has a smooth, flat surface portion and is located on top of the engine's cylinder head and covers all of the cylinders and is as wide as the diameter of the pistons in the engine, said base being in a plane at right angles to the direction of the stroke of the engine's piston, said base having a separate orifice through same into the combustion chambers of each of the respective cylinders, the centers of said orifices being in a straight line over the centers of said respective cylinders, said orifices being auxiliary-exhaust valve openings for the respective cylinders; and each auxiliary-exhaust assembly comprised of a sliding-plate piston, each of said pistons being retained in and guided by means of a frame secured to the top of the cylinder head, each of said pistons being a straight, flat strip of smooth metal as long as the flat sliding-plate valve base and uniform in thickness and uniform in width except that one edge is indented with notches of equal length and width alternately with standing portions thereof, and which standing portions are also of equal length and width, said notches and standing portions constituting a series of auxiliary-exhaust valves on each of said flat sliding-plate pistons and each auxiliary-exhaust assembly also comprising an auxiliary-exhaust valve train from said piston to an auxiliary-exhaust-valve control lever in the vicinity of the steering wheel of the automobile, which levers when actuated, move the pistons with their auxiliary-exhaust valves back and forth over the orifices in said sliding-plate valve base to open and to close the auxiliary-exhaust valves; and the auxiliary-exhaust assemblies thereby providing a facility to open the auxiliary-exhaust valves of either group-one or of group-two cylinders when fuel is being fed to and power is being produced in only the other cylinders, and to close all auxiliary-exhaust valves when fuel is being fed to and power is being produced in all cylinders; and two auxiliary-exhaust assemblies, including their respective controls being able to minimize the loss of power, which loss would otherwise occur in creating compression in the non-power-producing cylinders; and whereby said coordinated and integrated system of fuel-line assemblies and said auxiliary-exhaust assemblies together with their respective controls operate as follows to conserve fuel in the operation of automobiles on highways:

(a) all auxiliary-exhaust valves should be closed and all fuel valves should be open to obtain maximum power, when needed;

(b) the fuel valve in one of the fuel-line assemblies should be open and the fuel valve in the other fuel-line assembly should be closed when the power derived from the cylinders that are being fed fuel is sufficient, and the auxiliary-exhaust valves for the non-power-producing cylinders should be open to minimize the loss of power, which loss would otherwise occur in creating compression in the non-power-producing cylinders; and (c) to meet intermediate power requirements, close all auxiliary-exhaust valves, provide a full flow of fuel through one fuel-line assembly and as much of a flow through the other fuel-line assembly as may be desired.

* * * * *